United States Patent [19]

Prager et al.

[11] Patent Number: 4,797,534

[45] Date of Patent: Jan. 10, 1989

[54] PTC THERMISTOR HEATING DEVICE

[75] Inventors: Lee A. Prager, Raymond; Mason Ide, Gorham, both of Me.

[73] Assignee: GTE Products Corporation, Stamford, Conn.

[21] Appl. No.: 59,291

[22] Filed: Jun. 8, 1987

[51] Int. Cl.[4] ..... H05B 3/78; F24H 1/20; F28D 15/00

[52] U.S. Cl. ..... 219/326; 219/338; 219/505; 219/530; 219/540; 219/544; 338/22 R

[58] Field of Search ..... 219/205, 206, 207, 316, 219/318, 319, 335–338, 530, 540, 544, 504, 505, 325, 326, 513, 523; 338/22 R

[56] References Cited

U.S. PATENT DOCUMENTS

| | | | |
|---|---|---|---|
| 2,918,561 | 12/1959 | Perez | 219/316 X |
| 3,719,796 | 3/1973 | Abildtrup | 219/504 X |
| 4,029,941 | 6/1977 | Huebscher et al. | 219/523 |
| 4,104,507 | 8/1978 | Tisome et al. | 219/513 |
| 4,105,895 | 8/1978 | Kennedy | 219/540 X |
| 4,131,785 | 12/1978 | Shutt | 219/326 |

FOREIGN PATENT DOCUMENTS

| | | | |
|---|---|---|---|
| 25538 | 2/1979 | Japan | 219/540 |
| 1234251 | 6/1971 | United Kingdom | 219/338 |

*Primary Examiner*—Anthony Bartis
*Attorney, Agent, or Firm*—James Theodosopoulos

[57] ABSTRACT

A heater adapted to be disposed in a vessel whereby to heat liquids contained therein. The heater includes a sealed heat-transmitting cannister that is adapted to be immersed in a vessel containing a liquid media. A foraminous PTC thermistor is disposed in the cannister and electrically insulated therefrom. The thermistor is supported in the cannister by a pair of braces resting upon the inside wall surface of the cannister and each brace includes a pair of facing channels engaging the edges of the thermistor. Electrical connections are provided to convey current to opposite sides of said PTC thermistor. A quantity of electrically inert vaporizable fluid of a predetermined boiling point partially fills the cannister to a level covering the thermistor whereby when current is passed to opposite sides of said PTC thermistor, the fluid will boil and then condense upon the walls of the cannister and give up its latent heat of vaporization and radiate heat into said vessel. The anomoly point of the PTC is at or above the boiling point of the fluid.

12 Claims, 1 Drawing Sheet

PTC THERMISTOR HEATING DEVICE

FIELD OF THE INVENTION

The present invention relates to heating devices and particularly to heating devices that utilize PTC thermistors to provide heat to objects and especially to liquids. The invention specifically relates to the use of a PTC thermistor as a source of heat in a hot water heater or evaporator.

BACKGROUND OF THE INVENTION

PTC thermistors are well known to the art. Such devices have previously been used as heaters, and are generally made from doped barium titinate ceramics that have been coated with metallized electrodes. When the electrodes are connected to a current supply, the doped barium titinate ceramic exhibits a sharp positive temperature coefficient of resistance. The ceramics are designed so that below a critical temperature, their anomoly temperature, the resistance of the material remains at a low value and is essentially constant. When the predetermined temperature is reached, a crystalline phase change takes place in the ceramic and this change in crystalline structure is accompanied by a sharp increase in the resistance at the crystalline grain boundaries. The result of this crystalline change is an increase in the thermistor's resistance of several orders of magnitude over a small temperature change. For example, barium titinate thermistors with a room temperature resistance of 3.0 ohms can increase to 1,000 ohms or more during the crystalline phase change. The temperature at which the crystalline phase change takes place can be adjusted in the manufacturing process and can be established between about −60° F. and 600° F., and even higher. When energized with a suitable current by applying voltage to the opposite sides of the PTC thermistor, the ceramic rapidly heats up to a predetermined operating temperature and then "locks in" at this temperature. This rapid heating is due to the initial low resistance of the PTC thermistor which results in an initial high power of the heater. The "lock in" is due to the abrupt increase in resistance which causes the generated power to be reduced until it equals the dissipated power. At this point, thermal equilibrium is achieved and the PTC thermistor becomes self-regulating at the predetermined temperature.

Commonly, PTC thermistors that are used for heaters are attached to a heat sink and are electrically isolated from the media being heated through an electrical isolation means. The temperature of the media to be heated is dependent upon the heat flow through the PTC, the heat sink, and the electrical isolation means. As the temperature of the PTC thermistor is increased, the temperature drop between the PTC thermistor and the media being heated is significantly increased. When the heat flow decreases, as in the case of a water heater or an evaporator that becomes void of water, the heater temperature increases and can easily exceed safe limits of about 300° F. In addition, from time to time, the PTC thermistors may individually vary in their anomoly temperatures which can cause significant changes in heater performance from heater to heater. Moreover, the construction of the heater can vary from unit to unit. thereby also causing changes in heater performance.

We have found that the disposition of a PTC thermistor in a sealed, thermally conductive cannister which is filled with an electrically inert fluid which boils at or below the anomoly temperature of the PTC thermistor and condenses at a temperature below the boiling point of the media being heated can provide an excellent mechanism for heating a wide variety of medias, especially liquids. The inert fluid is boiled in the cannister by the PTC thermistor, and the vapor condenses upon the inner walls of the cannister because the condensation temperature is less then the temperature of the media being heated. When the vapor condenses, it gives up its latent heat of vaporization and heats the cannister which will radiate the heat to the media being heated. The cannister cannot be heated above the boiling point of the fluid held within it. The heater of the present invention provides an efficient heat transfer from the PTC thermistor through the use of the phase change of the dielectric fluid from liquid to vapor and the subsequent phase change of condensing of the vapor on the walls of the cannister. Safe operating limits cannot be exceeded because the PTC thermistor cannot exceed its anomoly temperature and the fluid cannot be heated above its boiling point.

Preferably, the fluid that is used is one of the Fluorinert family of electronic fluids. Fluorinert is a registered trademark of the 3M Corporation. Fluorinert fluids are a family of completely fluorinated organic compounds which are formed from common organic compounds by replacement of all carbon bound hydrogen atoms with fluorine atoms. These fluids are extremely non-polar and have low solvent action. They are colorless, odorless, low in toxicity and non-flamable. Because of a high thermal stability and low chemical reactivity, the fluids leave essentially no residue upon being heated or boiled. The fluids further provide a high degree of electrical protection, that is electrical insulation, and can have boiling points well within the necessary ranges for the heater of the present invention. Conveniently, a desired boiling point can be selected from a variety of boiling points available from the family of Fluorinert fluids. Typically, these boiling points can be between about 50° and 250° C. As stated previously, in the preferred embodiment of this invention, the anomaly temperature of the PTC thermistor is equal to or above the boiling point of the fluid that is used and is also selected to be one which is below a predetermined maximum temperature of the heater.

DESCRIPTION OF THE PREFERRED EMBODIMENT

Figure 1:
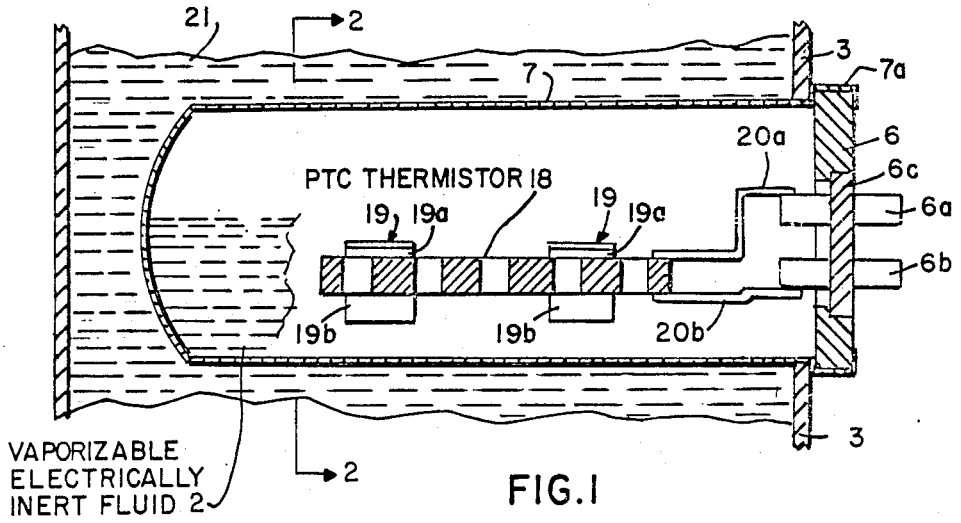
FIG. 1 is a cross-sectional, side elevational view of the heater of the present invention disposed in a media to be heated.

As shown in FIG. 1, the heater of the present invention includes a cannister 7 of a generally cylindrical shape with a flange *7a* disposed on an open end. A cover ring 6 is disposed within the flange *7a* and is sealed thereto by means of conventional adhesives which have sufficient strength to prevent the seepage of gases at elevated pressures. A PTC thermistor 18 is disposed in the cannister 7 and is spaced from the inner wall surfaces thereof. The PTC thermistor 18 is formed of the conventional barium titinate matrix with appropriate dopents and is formulated so as to have an anomoly temperature in the range of 120° to 180° C. when the heater of the present invention is used for heating water. A conventional metallized electrode (not shown) is coated on the upper and the lower sides of the PTC thermistor 18 for connection to a power supply as will be described hereinafter. The cannister 7 is disposed in the media 21 to be heated, the media 21 being contained within a vessel 3. The vessel 3 may be a conventional water heater.

Figure 2:
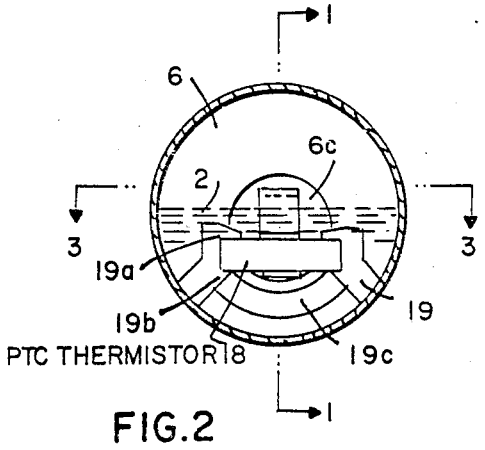
FIG. 2 is a view in cross-sectional, end view taken along the lines 2—2 of FIG. 1.

A brace 19 is disposed against the walls of the cannister 7 so as to support the PTC thermistor 18 in a fixed location. The brace 19 can be formed of an electrically inert material, such as plastic, and may be molded to accommodate the shape of the sides of the PTC heater, as best shown in FIG. 2. With special reference to FIG. 2, it can be seen that the brace 19 can be formed of a pair of opposing channel members **19*a* which are disposed upon legs 19*b*. Legs 19*b* are spaced from each other by a strap 19*c* that urges channel members 19*a* against the PTC thermistor 18, whereby the PTC thermistor 18 is fairly rigidly disposed and electrically insulated from the cannister 7**.

The PTC thermistor 18 is preferably disposed upon a pair of lead in elements **20*a* and 20*b*. These lead in elements 20*a* and 20*b* are attached to opposite sides of the PTC thermistor 18 and suspend it inside the cannister 7. The suspension of the PTC thermistor 18 separates the PTC thermistor 18 from the cannister 7 to allow for the free flow of fluid 2 around the thermistor 18 and in the cannister 7. As shown, the PTC thermistor 18 is preferably foraminous so that the maximum amount of contact can be achieved between the fluid 2 and the PTC thermistor 18. The fluid 2 can be filled in the cannister 7 to any desired level but, preferably, the level is such that the PTC thermistor 18 is completely bathed in the fluid. Adequate free board space is allowed above the top so that the fluid 2 can boil, vaporize and condense upon the colder areas of the inner surface of cannister 7, whereby to give up its latent heat of vaporization and heat the liquid 21 that surrounds it in the cannister 3**.

Leads **20*a* and 20*b* are attached to a header assembly which includes a pair of electrical connectors 6*a* and 6*b* that are sealed within a cap 6*c*. Cap 6*c*, in turn, is sealed in the end cap ring 6. The various seals between the flange 7*a* and the end cap ring 6, and the contacts 6*a* and 6*b*, and the header assembly 6*c* must be adequate to withstand the pressures developed during vaporization of the fluid contained within the cannister 7**.

As shown, the cannister 7 is fitted into a side wall 3 of a heater and is completely immersed within the fluid 21. As mentioned above, the use of PTC thermistor as the source of heat for a water heater is quite advantageous. Previously, such heaters used resistance heating elements that require constant bathing in the water of the water heater. If the level of the water became too low, the resistance heating element would overheat and permanently damage itself. With a PTC thermistor as the source of the heat, the cannister reaches only the predetermined anomoly temperature of the PTC heater which shuts itself off automatically when that temperature is exceeded. Although the PTC thermistor will maintain itself at the predetermined anomoly temperature, it will not render itself inoperative because of overheating. The fluid in the cannister will continue to vaporize but will be maintained at the predetermined anomoly temperature.

Figure 3:
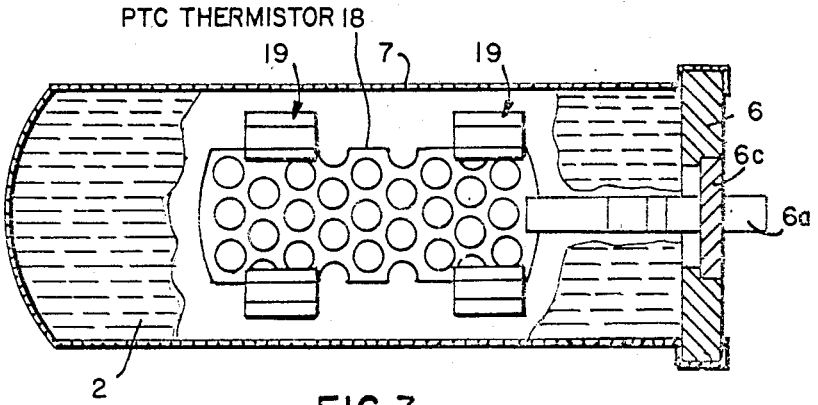
FIG. 3 is a cross-sectional, top view taken along the lines 3—3 of FIG. 2 and illustrating a construction of a preferred embodiment of the PTC thermistor.

Turning to FIG. 2, the disposition of the PTC thermistor 18 is preferably beneath the axis of the cannister 7 whereby to provide adequate space for the vaporized fluid held therein. With regard to FIG. 3, the PTC thermistor 18 is shown disposed centrally within the cannister 7 and supported on braces 19.

As has been mentioned previously, the vaporizable fluid disposed within the cannister 7 is preferably Fluorinert. The Fluorinert used has a boiling point, preferably, between about 50° and 60° C. so that it is entirely vaporized by the PTC thermistor disposed in the cannister 7 and is below the boiling point of the liquid to be heated. With a PTC thermistor having an anomoly temperature of about 140° C., Fluorinert having a boiling point begtween 50° and 60° C. can be successfully used to heat water. In applications where the liquids to be heated have other boiling points, appropriate adjustments in the anomoly temperature and the boiling point of the Fluorinert family has a boiling point between about 50° and 250° C. Sufficient Fluorinert is placed in the cannister to enable it to be heated and boiled by the PTC thermistor 18 so that the vapors can condense upon the wall of the cannister 7 and radiate heat to the liquid to be heated 21. Since the PTC thermistor 18 will establish itself at a predetermined operating temperature, and since the fluid that is being heated has a predetermined boiling point, neither the media being heated nor the cannister will rise above the predetermined temperature. This double safeguard prevents runaway temperatures in the cannister 7 if the media 21 being heated evaporates. We have found that the best heating conditions are achieved when the PTC heater 18 is immersed in the Fluorinert fluid 2 and the free board space is greater than about 50% of the volume of the cannister 7.

It is apparent that modifications and changes can be made within the spirit and scope of the present invention. It is are intention, however, only to be limited by the scope of the appended claims.

As our invention, we claim:

1. A heater adapted to be disposed in a vessel thereby to heat liquids contained therein, said heater comprising:

a sealed heat-transmitting cannister;

a PTC thermistor disposed within said cannister and electrically insulated therefrom;

means to convey current to opposite sides of said PTC thermistor;

at least one brace disposed in said cannister;

each said brace including a pair of channels which face each other and engage the edges of said PTC thermistor; and a partial fill of electrically inert fluid disposed in said cannister.

2. The heater according to claim 1 wherein there are two such braces spaced from each other and engaging the edges of said PTC thermistor and resting upon the inside wall surfaces of said cannister.

3. The heater according to claim 1 further including an end cap disposed on said cannister, a pair of leads, and connector means, said connector means extending through said end cap into said cannister, said leads being connected at one end to opposite sides of said PTC thermistor and at the other end, to said connector means.

4. The heater according to claim 1 wherein said PTC thermistor is foraminous.

5. The heater according to claim 1 wherein the cannister has an axis of rotation and the PTC thermistor is spaced from said axis of rotation.

6. The heater according to claim 1 wherein the fill of electrically inert fluid has a level at or above the upper surface of said PTC thermistor.

7. A heater adapted to be disposed in a vessel whereby to heat liquids contained therein, said heater comprising:

a sealed heat-transmitting cannister;

a PTC thermistor disposed within said cannister and electrically insulated therefrom;

means to convey current to opposite sides of said thermistor;

at least one brace disposed in said cannister;

each said brace including a pair of channels which face each other and engage the edges of said PTC thermistor; and a partial fill of electrically inert fluid disposed in said cannister, said fluid having a boiling point below the anomoly temperature of said PYC thermistor and below the boiling point of a liquid contained in a vessel into which the heater may be disposed, whereby said fluid will vaporized from the heat of said PTC thermistor and condense on the walls of said cannister and give up its latent heat of vaporization to heat the liquid in the vessel.

8. The heater according to claim 7 wherein there are two such braces spaced from each other and engaging the edges of said PTC thermistor and resting upon the inside wall of said cannister.

9. The heater according to claim 7 further including an end cap disposed on said cannister, a pair of leads, and connector means, said connector means extending through said end cap into said cannister, said leads being connected at one end to opposite sides of said PTC thermistor and at the other end, to said connector means.

10. The heater according to claim 7 wherein said PTC thermistor is foraminous.

11. The heater according to claim 7 wherein the cannister has an axis of rotation and the PTC thermistor is spaced from said axis of rotation.

12. The heater according to claim 7 wherein the fill of electrically inert fluid has a level at or above the upper surface of said PTC thermistor.

* * * * *